US007882796B2

(12) United States Patent
Radow

(10) Patent No.: US 7,882,796 B2
(45) Date of Patent: Feb. 8, 2011

(54) DISPENSER CABINET

(76) Inventor: Marc Radow, 1900 Joy Lake Rd., Reno, NV (US) 89511

( * ) Notice: Subject to any disclaimer, the term of this patent is extended or adjusted under 35 U.S.C. 154(b) by 99 days.

(21) Appl. No.: 11/077,559

(22) Filed: Mar. 9, 2005

(65) Prior Publication Data

US 2006/0201417 A1 Sep. 14, 2006

(51) Int. Cl.
*B05C 21/00* (2006.01)
*A47B 71/00* (2006.01)

(52) U.S. Cl. ..... 118/13; 206/303; 206/486; 206/490; 206/503; 220/495.03; 220/23.87; 312/348.3; 312/330.1; 312/351

(58) Field of Classification Search ..... 118/13, 118/407, 477, 483, 562, 564; 206/303, 486, 206/490, 503; 220/495.03, 23.87; 312/348.3, 312/330.1, 351, 107, 111
See application file for complete search history.

(56) References Cited

U.S. PATENT DOCUMENTS 1,967,280 A * 7/1934 Behr ..... 220/553
1,985,412 A * 12/1934 Jackson ..... 280/79.2
2,220,285 A * 11/1940 Rodd ..... 248/313
2,343,356 A * 3/1944 Zalkind ..... 312/261
3,042,384 A * 7/1962 Bauman ..... 165/42
3,251,636 A * 5/1966 Hein ..... 312/122
3,952,905 A * 4/1976 Rumrill ..... 220/592.14
4,898,294 A * 2/1990 Jennings ..... 220/592.09
5,269,599 A * 12/1993 Moring ..... 312/290
5,713,584 A * 2/1998 Crane ..... 280/47.35
2005/0089669 A1 * 4/2005 Sobonya et al. ..... 428/95

OTHER PUBLICATIONS

CR Manufacturing, Marga-Ezy Rimmer, Jun. 7, 2005, 2 pages, www.crmfg.com/product_index/p18.html.
Bellboy Corporation, Margrita Rimmer, Jun. 7, 2005, 2 pages, www.bellboycorp.com/supplies/marmix.html, www.bellboycorp.com/supplies/images/saltrim.jpg.
Learn bartending.com, 3 Tier Salt and Sugar Glass Rimmer, 1 page, www.learnbartending.com/bartenders/bartending_kit.asp, (2005).

* cited by examiner

*Primary Examiner*—Laura Edwards
(74) *Attorney, Agent, or Firm*—Henricks, Slavin & Holmes LLP

(57) ABSTRACT

A method and a device for preparing drinkware where a substance is applied to the rim of the drink-ware and substances can be dispensed from the device. One device includes a cabinet that can house and dispense substances, and the substances may either be filled directly into receptacles, stands, arms or drawers and/or pre-filled in contoured drawer liners. The cabinet may include a moistening reservoir and separates the moistening reservoir from the Spice by housing the moistening agent in a distinct and separate location.

42 Claims, 6 Drawing Sheets

DISPENSER CABINET

BACKGROUND OF THE INVENTION

This invention relates to a novel method and a novel device for applying a dry granular, flaked, shaved or powder substance (Spice) to the rim of drinkware, when two or more Spice options are desired to select from. The device provides for easy access to the Spices, economizes available bar space and protects and preserves the components of the drinkware rimming system (Spices, wetting agent and suspension material) in the preparation of rimming a beverage of any type, nature, alcoholic or otherwise.

Rimming drinkware for beverages unto itself is not novel. The margarita, a cocktail which is generally made with tequila liquor mixed with lime, lemon and other juices and cordials has been served in drinkware whose rims were coated with salt. This salted rim application has customarily been accomplished by moistening the rim of the glass with an aqueous solution and inserting the moistened rim into a dish or reservoir of salt.

Rimming drinkware, however, has grown in popularity as on-premise establishments (e.g. restaurant, nightclub, clubhouse, café, bar, tavern, etc.) strive to improve consumer perception of drink values, reduce costs and/or offer presentations where consumers otherwise may not readily have access to. Traditional salt as described in the above Margarita example, and similarly ordinary sugar, have fallen short of consumer and vendor expectations. Spices, however, with their brilliant colors, array of flavors and powerful aromas that include expensive food science ingredients and preparations have captured both consumer and vendor imagination. As a result the number and complexity of different Spice preparations have exploded.

Current rimming devices 'rimmers' were designed for salt and sugar as explained above. Both salt and sugar have no added ingredients and are relatively inexpensive commodities. There had been little or no cause for handling with increased or specialized care, protecting or preserving them. For example, when cleaning the devices, excess salt or sugar could easily be discarded.

Rimmers also are designed to accommodate at most two 'Spice' selections (e.g. salt and sugar) and, if so equipped, inadequately separate a moistening agent and/or suspension material, such as a sponge, away from the Spice to avoid cross contamination.

Spice formulations today include expensive flavors, colors and food ingredients for specific performance criteria. The preparations can be expensive, particularly in contrast to ounce/ounce comparisons to both salt and sugar commodities and vendors are reluctant to simply discard unused quantities. It is undesirable for one Spice preparation to interfere, blend or mix with any other Spice(s) and particularly adverse for the moistening agent to contaminate any of the Spices due to evaporation, spilling or other possible mishap.

New beverage options enter the marketplace every day and continue to crowd bars and beverage preparation areas. As a result, vendors are seeking to economize every aspect of space, use every ounce of product and to maximize productivity while offering exciting and diverse preparations. Traditional rimmers would force vendors to attempt to use many individual dispensers or use many traditional rimmers, but all of such alternatives are undesirable in terms of their functionality, ergonomics, preservation of the spice and space utilization. The concept of rimming beverages has suffered as a result of these inadequacies. The Rimming Cabinet as described herein resolves the presented obstacles.

BRIEF SUMMARY OF THE INVENTION

The present invention is directed to a novel device and method of applying a dry granular, flaked, shaved or powder substance (Spice) to the rim of common drinkware and to afford access to two or more Spice selections for use in a preferred embodiment of that method.

The present invention addresses and solves the logistic, ergonomic and economic considerations presented. The present invention houses two or more Spice selections, separates and protects one Spice from all others, easily allows users to remove one spice from the cabinet for cleaning/exchanging/replenishing purposes, separates and protects all spices from the wetting agent and its reservoir and/or Rimming Dish and consumes less area than traditional rimmers in overall footprint and particularly on a per spice to area ratio.

In accordance with the method of this invention, a wetting agent is applied to the rim of drinkware to moisten its rim. The drinkware, again inverted, is introduced into customarily one (or more) said Spice selections, which thus adheres to the rim of the drinkware by virtue of the kinematic forces present in the moisture on the moistened rim.

A principal object of this invention is to provide a novel and improved method and device of dispensing or otherwise making easily available two or more Spice selections from the same device in preparing a beverage whose rim is coated with a Spice and similarly to apply the wetting agent by means of the same device.

Two or more Spice dispensing locations by means of Drawers, arms, stands or otherwise (Drawers) are shaped and contoured so that the Spice when introduced into the Drawer, due to the force of gravity, naturally draws the spice to the outer edges of the interior contour of the Drawer. This distribution effect causes the Spice to be more efficiently utilized, increasing yield per ounce of Spice and reducing potential waste of remaining Spice in the Drawer and further when drinkware is inverted and introduced into the drawer, the Spice may more completely extend over the drinkware rim.

A contoured Liner may be inserted and fitted into the Drawer thereby protecting and separating the Drawer from the Spice and better facilitate exchanging a Spice in a particular Drawer and cleaning a Spice from a Drawer. Further, a Liner may be required to house the Spice into a fitted, contoured and a hollowed Drawer. In either Drawer scenario, e.g. hollowed or contoured/fitted, the Liner may be pre-filled, re-filled, removed, discarded, cleaned and/or readily exchanged with the same or different Spice in any one or other Drawers.

Similarly, the Liner may also be contoured so Spice will migrate naturally due to the forces of gravity toward the interior outer edges of the Liner due to gravity's presence on Spice in the Liner and Spice will migrate away from the center point of the Liner, down its descents and toward the outer and interior edge of the Liner's plane. This process affords greater contact area over drinkware rim and the Spice. The process will further afford greater utilization of Spice (e.g. less waste) in the liner and/or drawer.

The device also provides for a wetting reservoir and area for the customary practice of applying a wetting agent to the rim of the drinkware when it is inverted and its rim introduced into the wetting agent. This wetting reservoir may similarly be contoured (female) to accommodate a liner styled apparatus or Rimming Dish (male). In either scenario, the wetting reservoir or the Rimming Dish would house and serve to apply the wetting agent, and if so desired include a suspension material such as a sponge, to apply the wetting agent to the rim of the drinkware when it is inverted and introduced into the wetting agent and/or suspension material.

The wetting reservoir and Rimming Dish is of greater depth and height than that of the suspension material so as to reduce the potential for spilling or overflow of the wetting agent when the wetting agent is applied into the wetting reservoir and/or onto the suspension material. And further to reduce the potential for overflow of the wetting agent over the wetting reservoir and/or Rimming Dish when drinkware is introduced into the wetting reservoir, Rimming Dish or suspension material causing a reduction in capacity for the wetting agent in the wetting reservoir and Rimming Dish.

The Rimming Dish can be contoured with thumb and finger grasp center post and peripheral edge so that either location(s) may serve as handling points. These handling points will facilitate removal, replacement to refill, replace, discard, clean and/or readily exchange with new Rimming Dish, wetting agent and or suspension material.

The Cabinet is an encompassing drinkware rimming system of the features identified herein to accommodate, house and dispense two or more available Spices with which to select from and to apply that Spice. Spice may either be filled directly into receptacles, stands, arms or drawers (Drawers) and/or pre-filled in contoured Drawer Liners (Liners) that fit into molded and shaped receptacles of the Drawers of the Cabinet. A Liner may be filled prior to inserting into a Drawer or refilled while in the Drawers. The Cabinet contains two or more Drawers whereas each Drawer accommodates one Spice at a time.

The Cabinet and its Drawers house and protect the Spice. The Cabinet provides for a drinkware moistening area (Moistening Reservoir) and separates this moisture from the Spice by housing the moistening agent in a distinct and separate location.

The dimensions of the Cabinet, Drawers, Liners and moistening area may be manufactured in different sizes so as to accommodate small diameter as well as common large diameter drinkware (e.g., small shot glass style to larger martini and margarita style drinkware). The Cabinet and its corresponding parts will support the weight and force of depressing drinkware into the moistening area and into a Drawer filled with Spice when the drawer is extended and in use.

The Cabinet enhances drinkware rimming ergonomomics and limited bar space.

The Cabinet and its corresponding parts may be manufactured from any rigid material including but not limited to plastic, cardboard, ceramic, wood and/or metals such as stainless steel or aluminum or a combination of these materials.

A method and a device for preparing a drinking glass, cup, mug or other beverage container (Drinkware) where any dry granular, flaked, shaved or powder substance (Spice) is applied to the rim of drinkware and where two or more Spices are dispensed from the same device. Where the drinkware is inverted and introduced into the spice and in order to adhere the Spice to the rim of the drinkware, the rim is customarily moistened with a liquid or wetting substance (moistening agent) and such moistening agent is housed in the same device.

Further objects and advantages of this invention will be apparent from the following detailed description of presently preferred embodiments with reference to the accompanying drawings.

A device, encasement and/or cabinet that dispenses and makes available two or more selections of any dry granular, flaked, shaved or powder substance (Spice) to apply to the rim of drinkware.

The Cabinet to house or otherwise accommodate separate and independent stands, sleeves, platforms and/or arms (Drawers) that rotate, slide or extend so as to make the Spice accessible to introduce drinkware into Spice for the purpose of applying the Spice to the rim of the Drinkware.

A device as set forth above, wherein the Drawers may be contoured into a receptacle (female) so that a mating (male) Liner may be fitted and/or inserted into the Drawer.

Whereas Spice may be introduced and filled directly into a drawer, or into a Liner.

Whereas the Drawer may be shaped so that it may only house Spice when a Liner is inserted into the drawer (e.g., a hollowed drawer).

A separator and division between Spice compartments/Drawers that distinguishes the area surrounding of one Spice and Drawer and protects this one Spice from adjacent and all other Spices while a Drawer is either extended, rotated or closed in the Cabinet.

A Reservoir Area for a moistening agent to moisten the rim of the Drinkware so as to adhere and apply the Spice to the rim of the drinkware.

Whereas the Reservoir Area may be contoured as a receptacle (female) to accommodate a contoured (male) Rim Dish that houses and accommodates a moistening agent.

The Reservoir and/or Rim Dish may also accommodate a suspension material such as a Sponge or other material to suspend the wetting agent, liquid, gel, aqueous or other wetting substance.

Whereas the Reservoir Area and/or the Rim Dish is of greater depth and height than the suspension material (sponge) and/or the wetting agent.

Whereas the Reservoir Agent and/or the Rim Dish are separated and distinguished from the areas containing Spice so as to avoid contamination or migration due to evaporation, spills or other mishap of either the Spice, the Wetting Agent or suspension material.

A sliding, rotating, folding or extending cover or other opening/closure contraption that will envelop the Reservoir Area to protect and preserve the wetting agent and/or its suspension material when not in use.

Whereas the wetting area and/or Rim Dish and its/their components are integrated into the same Cabinet device.

The extension of the base (e.g. footprint), that accommodates the wetting reservoir and/or Rimming Dish, is extended in the direction of the Drawer opening and creates a lever point at the furthest point in the front of the base of the Cabinet (in the direction of the drawer extension), so that when a Drawer is opened, particularly one that is filled with Spice and particularly when drinkware is depressed into the Spice, the resulting weight and downward forces could otherwise topple the Cabinet forward in the direction of the extended drawer and make the structure less sturdy. The extension of the base affords stability when a Drawer is extended and when drinkware is depressed into a Drawer and Spice.

The bottom surface area of the base where the Cabinet makes contact with that of any countertop, table top or other surface the Cabinet may rest upon can be fitted with a waterproof, nonskid and/or elevated surface so as to prevent the cabinet from trapping water or moisture beneath the Cabinet commonly found in bar applications and from restricting the Cabinet from sliding forward or backward when a Drawer is either extended or retracted.

Figure 2:
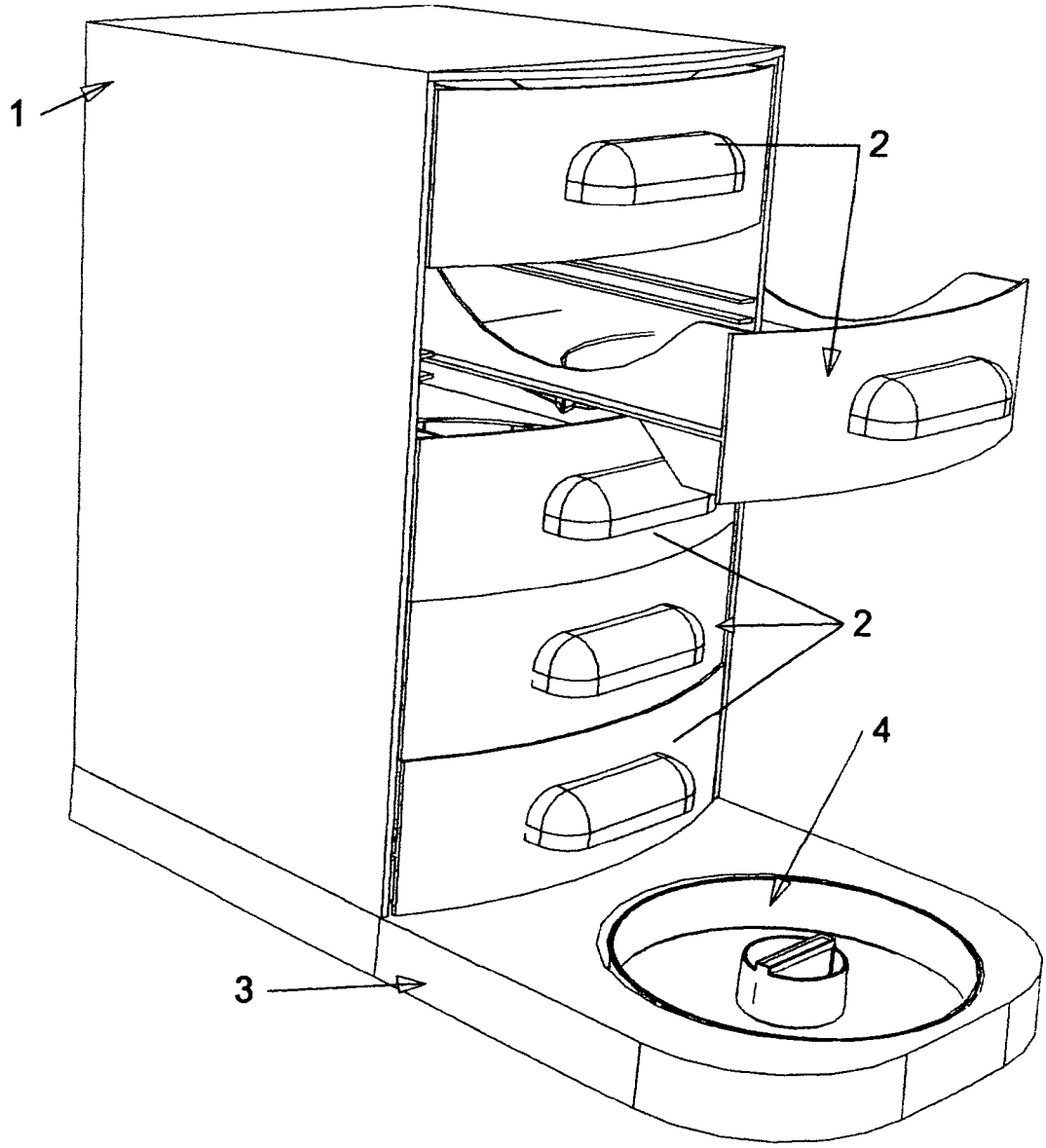
Figure 3:
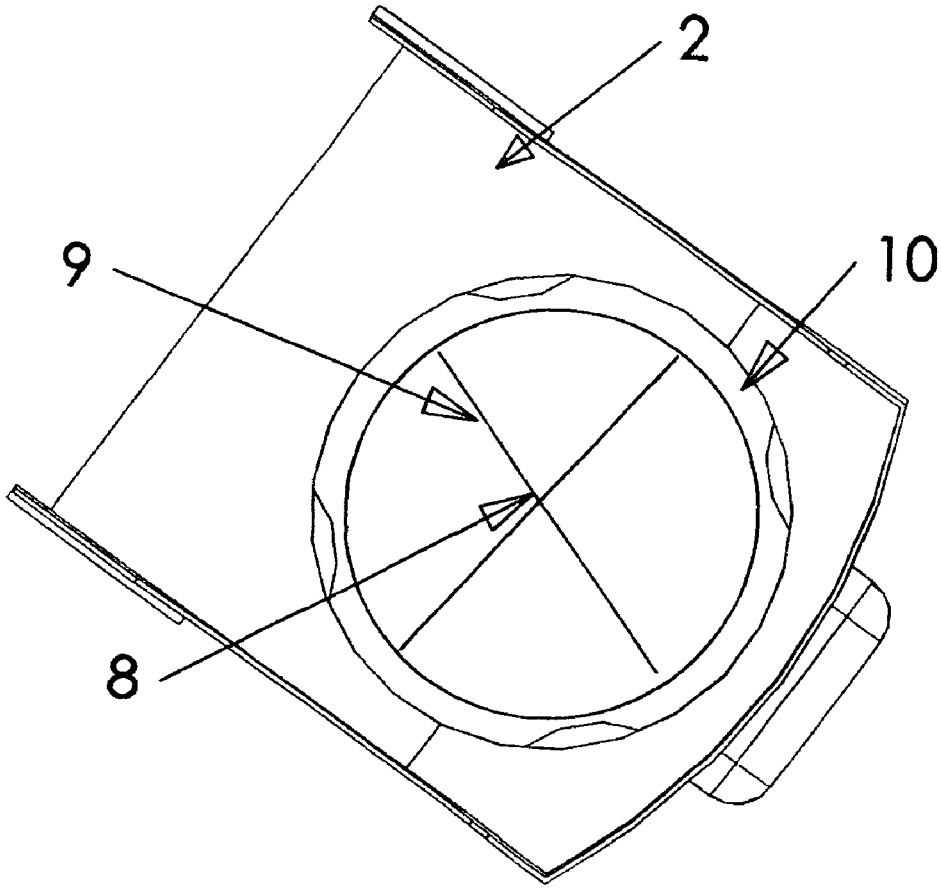
Figure 3A:
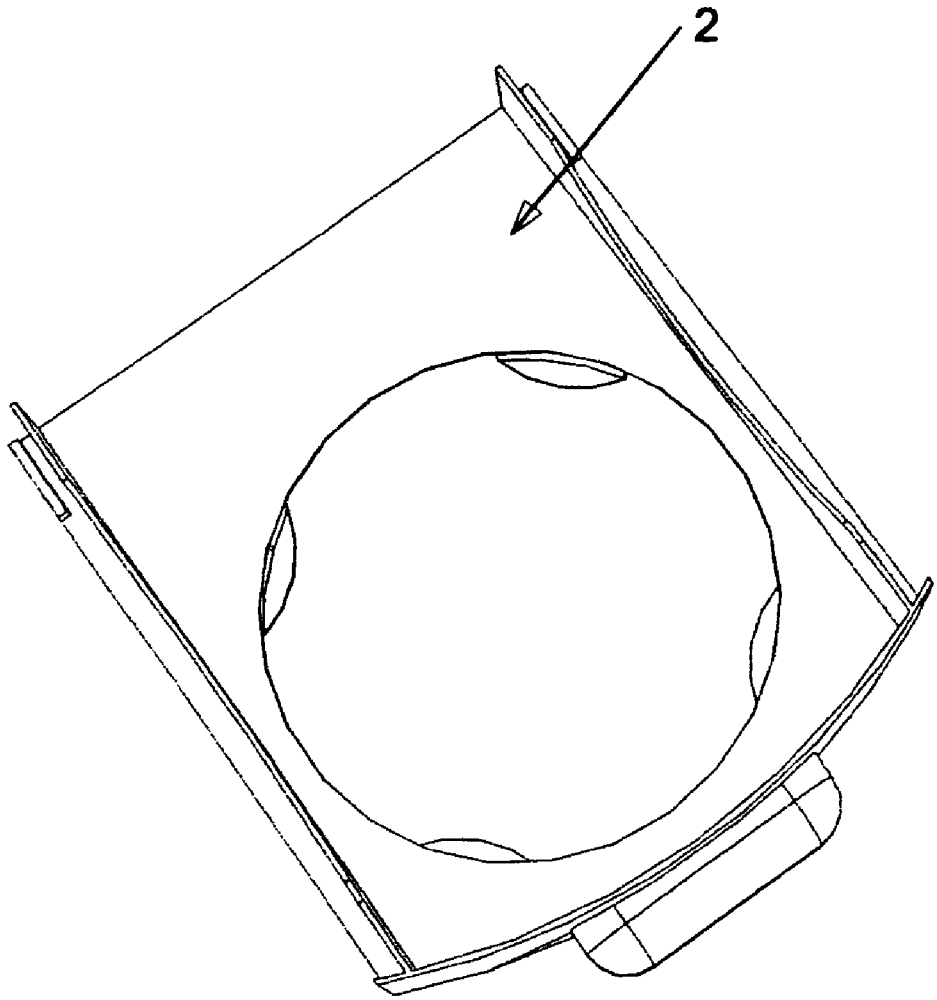
Figure 4:
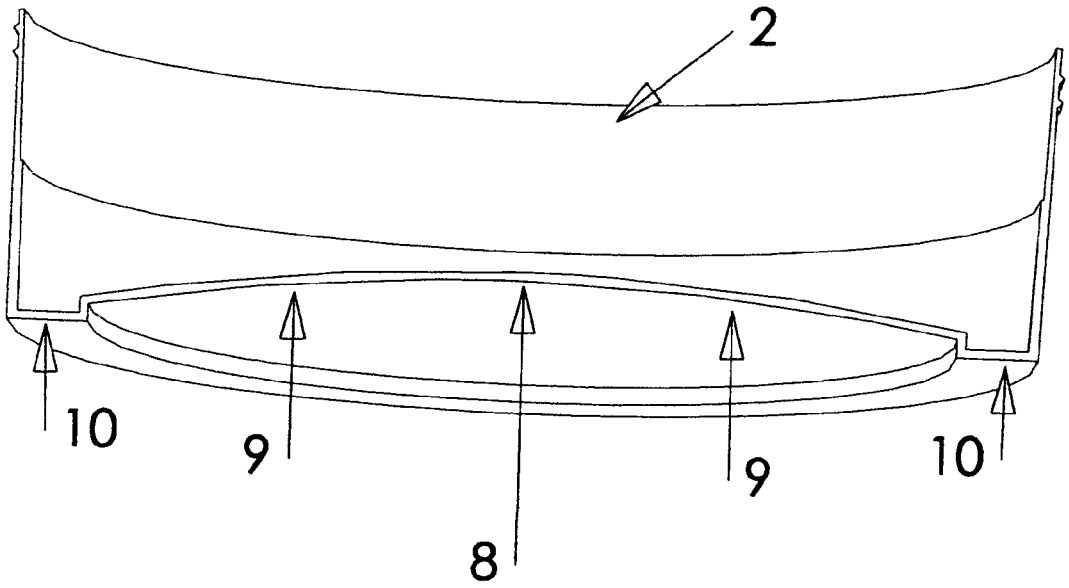
Figure 5:
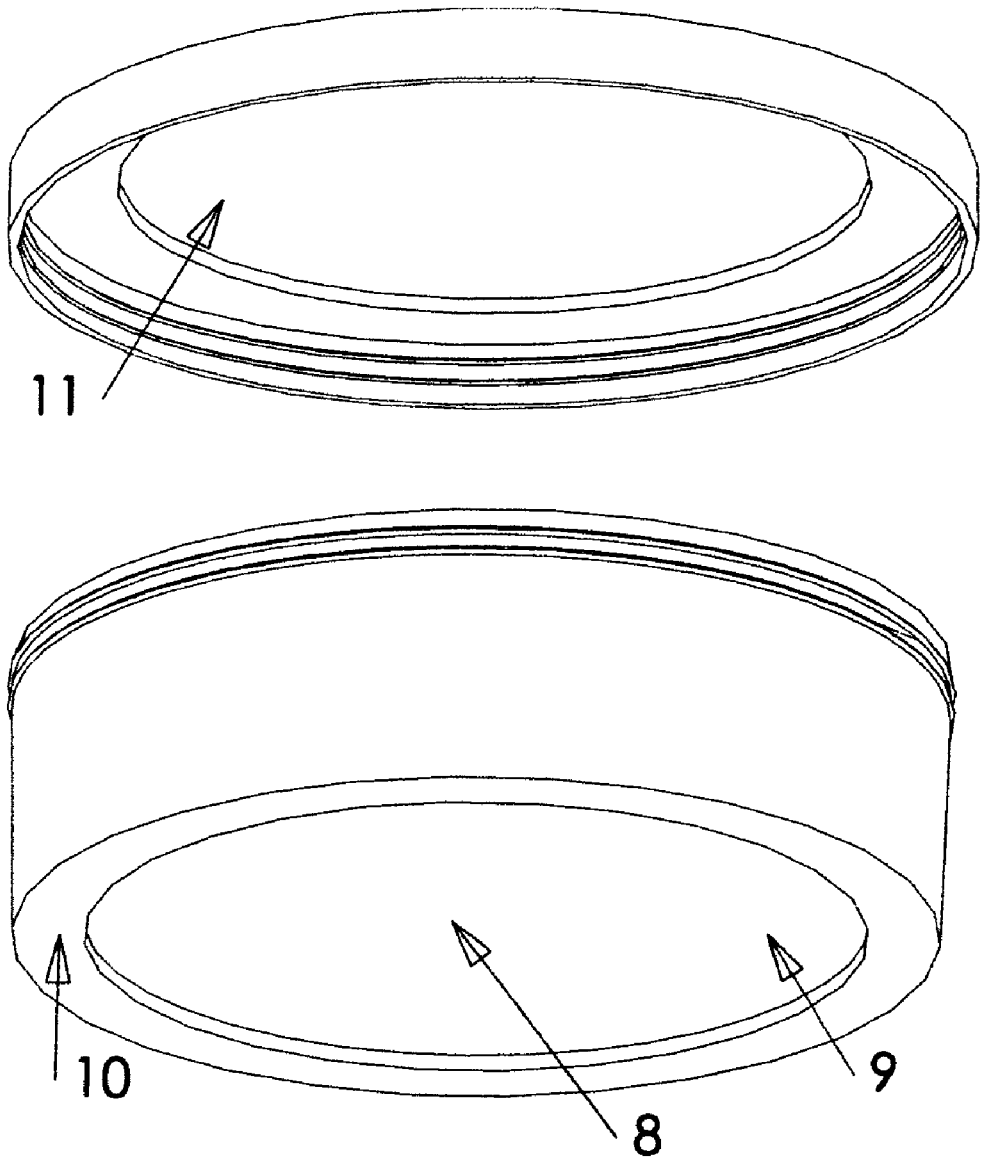

FIG. 2 is an isometric view of the Cabinet in accordance with one or more novel aspects of the present invention and for use in practicing the method of this invention;

FIGS. 3 and 3*a* are top views of the Drawer in accordance with one or more novel aspects of the present invention and for use in practicing the method of this invention;

FIG. 4 is a sectional view of the Drawer of FIG. 3 in accordance with one or more novel aspects of the present invention and for use in practicing the method of this invention; and FIG. 5 is a perspective view of an optional Liner which fits into the Drawer and a screw top or snap top lid that may be affixed to the Liner to further protect the Spice when not in use.

DETAILED DESCRIPTION OF THE PRESENT INVENTION

Before explaining the present invention in detail it is to be understood that the invention is not limited in its application to the particular arrangements shown and description since the invention is capable of other embodiments. Also, the terminology used herein is for the purpose of description and not of limitation.

Referring first to FIG. 2, the novel device shown consists of three predominant parts: the Cabinet encasement (1), the Drawers (2) and the Base (3). The Base provides for the Wetting Area (4) and sufficient footprint in the direction of the Drawer(s) opening so that the Base offers stability to the Cabinet when a Drawer is in use (extended, filled with Spice and/or Liner and drinkware is introduced and depressed into the Spice).

The Drawer (2) is contoured, shaped, vaulted and domed as shown in FIGS. 3 and 4, which elevates the center point of the Drawer (8) and gradually descends (9) to the periphery of the container terminating at a level plane (10). Or the Drawer may be hollowed as shown in FIG. 3*a* wherein a contoured Liner (FIG. 5) must be inserted into the Hollowed Drawer.

Figure 1:
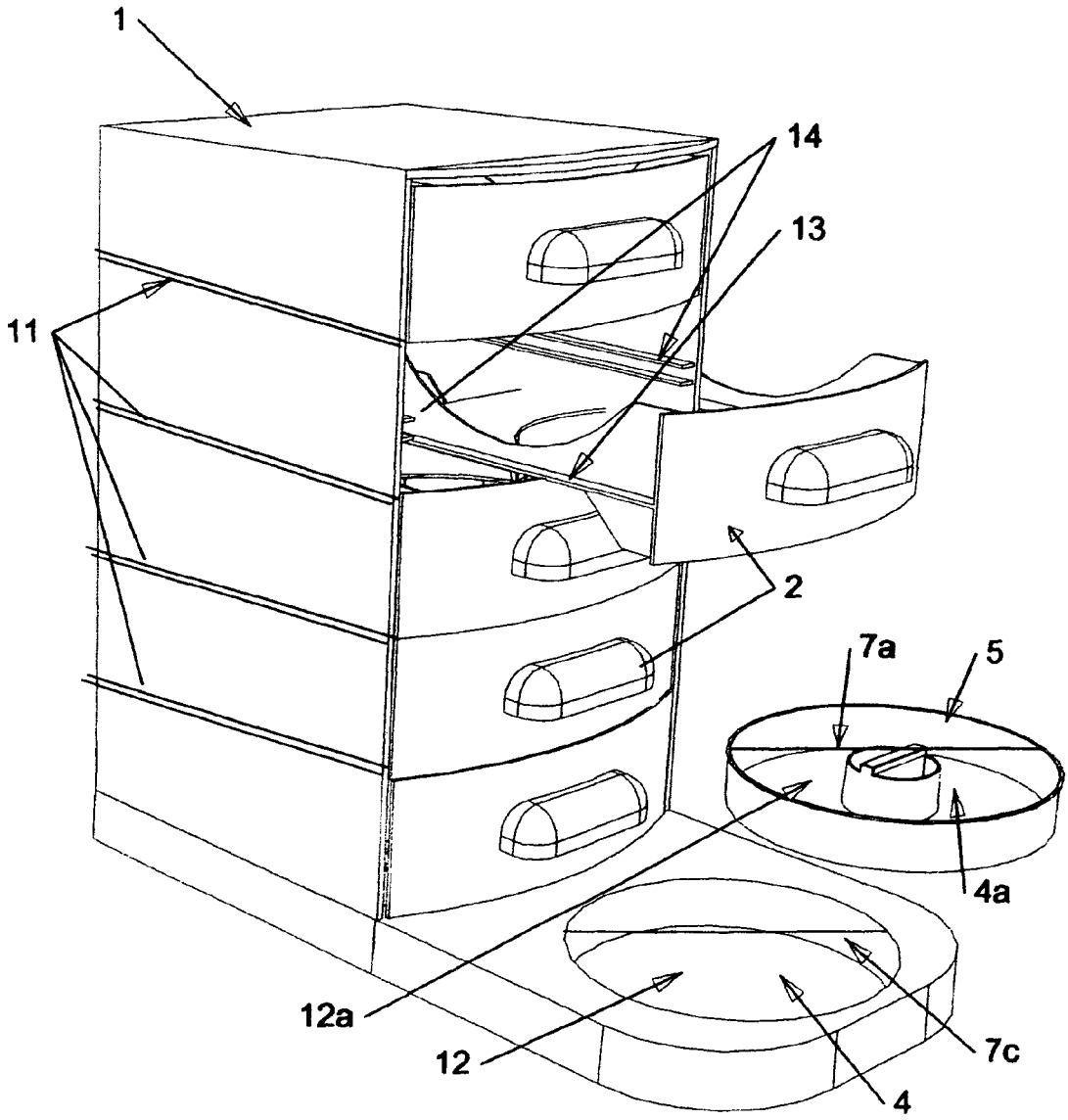
FIG. 1 is a perspective view of the Rimming Cabinet showing its internal aspects, including drawers, drawer liner option and drawer separators (that which distinguishes and separates one Spice location and housing from all other Spice selections including the wetting agent). It also depicts the wetting reservoir, Rimming Dish option and one drawer extended to expose the Spice in accordance with one or more novel aspects of the present invention for use in practicing the methods described in this invention.

The Drawer contours are designed such that a fitted and matching (male) Liner (FIG. 5) may be inserted into the Drawer (female) FIGS. 1 and 2, and/or hollowed drawer (FIG. 3*a*). In embodiments wherein the Drawer is hollowed (FIG. 3*a*), this hollowed area (15) will receive and accommodate the Liner as shown in FIG. 5. Further, the hollowed area may be fitted with supports (16) as shown in FIGS. 2 and 3*a* to hold the Liner in the intended location in the Drawer.

Shown in FIG. 1, are Separators (11), that are interior structures and shown as a double line, between Drawer compartments that segregate and distinguish one Spice housed in a Drawer, whether hollowed or not, and/or Liner from all other Spice compartments while the drawer is closed in the Cabinet encasement (1).

The Wetting Reservoir Area (4) shown in FIG. 1, accommodates directly the wetting agent or either a Rimming Dish and suspension material to suspend and apply a wetting agent. The Wetting Reservoir is contoured (female) to accommodate a (male) Rimming Dish (5). The diameters (7*c* and 7*a* of the Wetting Reservoir and Rimming Dish, respectively) cascade so that the Rimming Dish (5) will nest into the Wetting Reservoir (4) and are sufficient to accommodate common and large diameter drinkware when inverted and its rim introduced into the wetting agent.

Suspension material area(s) (12 and 12*a*) respectively of the Wetting Reservoir (4) and similarly of the Rimming Dish (5) are of greater depth and height than that of the suspension material so as to reduce the potential for spilling or overflow of the wetting agent when applied to the suspension material and further when drinkware is introduced into the same.

The Wetting Reservoir Area (4 and 4*a*) and Rimming Dish (5), including suspension material (12 and/or 12*a*) and wetting agent, and the moisture from the wetting agent, either through direct contact or due to the wetting agents' evaporation, are separated in proximity to avoid wetting agent or Spice contamination while being integrated into the same device.

A sliding, rotating, folding or other door contraption (not shown) may cover the Wetting Reservoir and/or Rimming Dish to protect and preserve the suspension material and wetting agent when not in use.

In FIG. 1, each Drawer (2) extends and slides open and contains either Spice filled directly in the Drawer or in a hollowed drawer (FIG. 3*a*) utilizing a Liner as shown in FIG. 5, that contains the Spice and that also matches the contours of the drawer with a center point (8), descents (9) and level planes (10) and additional vertical supports (16*a*) as shown in FIG. 3. Each Drawer is equipped with rails/grooves/guides (13) on both sides of the Drawer that guide the direction of the Drawer extension and retraction along with extension stops (not shown) to prevent the Drawer from overextension from the Cabinet encasement (1). Rails (13) slide along and inside sideways oriented "U" channel (14) positioned on the left and right sides of the cabinet encasement (1).

FIG. 5 shows a lid (17), either screw top or snap on, that can be used to secure and preserve Spice in the Liner while inside or outside of the Drawer, when not in use.

I claim:

1. A cabinet for use in applying a substance to a rim of drinkware, the cabinet comprising:

a frame defining an interior area;

structures within the interior area configured for supporting in respective first and second substance receptacles within the interior area and wherein the structures and the frame are configured for providing access from outside the frame to the first substance receptacle separately from the second substance receptacle when the first substance receptacle is supported by the structures and the first substance receptacle is moved relative to the frame;

a receptacle for receiving wetting material wherein the receptacle is sized to accommodate a rim of an item of drinkware and the first and second substance receptacles are also sized to accommodate the rim of the same item of drinkware;

wherein the first substance receptacle is removable from the interior area; and wherein the structures within the interior area include respective drawers each having a wall defining an opening configured to receive a substance receptacle and each also having a plurality of discrete lower supports for supporting an underside of the first substance receptacle.

2. The cabinet of claim 1 further comprising an edible substance in the first substance receptacle.

3. A cabinet for receiving an edible substance, the cabinet comprising:

a frame defining an interior area, and having a base for being supported on an underlying support surface, and wherein the base includes a non-skid surface and a portion fixed to the frame extending in a first direction, and including a liquid reservoir outside the interior area for receiving a wetting substance;

first and second drawers adjacent each other and movable within the interior area in drawer compartments in the frame, wherein the first drawer is movable independently of the second drawer and the first drawer includes a lower portion having a convex surface facing upward that is substantially circular in a plane of the drawer; and a separator element between the first and second adjacent drawer compartments;

wherein the first drawer includes a first wall extending at least partly vertically and wherein the first wall of the first drawer is substantially circular in horizontal cross section.

4. The cabinet of claim 3 further comprising an edible substance in the lower portion of the first drawer.

5. A cabinet for receiving an edible substance, the cabinet comprising:

a frame defining an interior area, and having a base for being supported on an underlying support surface, and wherein the base includes a non-skid surface and a portion fixed to the frame extending in a first direction, and including a liquid reservoir outside the interior area for receiving a wetting substance;

first and second drawers adjacent each other and movable within the interior area in drawer compartments in the frame, wherein the first drawer is movable independently of the second drawer and the first drawer includes a lower portion having a convex surface facing upward that is substantially circular in a plane of the drawer;

a separator element between the first and second adjacent drawer compartments; and a lowermost drawer and the base positioned below the lowermost drawer; and wherein the housing defines an enclosure and wherein the base extends beyond the enclosure in a direction of drawer movement.

6. The cabinet of claim 5 further comprising an edible substance in the lower portion of the first drawer.

7. The cabinet of claim 6 wherein the reservoir is configured for receiving and holding a liquid.

8. The cabinet of claim 5 wherein the reservoir is configured for receiving and holding a liquid.

9. An apparatus for use in applying an edible granular substance to a rim of drinkware, comprising:

a cabinet device including:

a support base adapted to rest on and be supported on a support surface;

a frame connected to the support base;

a first support structure connected to the frame and movable between an open position and a closed position; and a second support structure connected to the frame and movable between an open position and a closed position; and a recessed wetting receptacle supported by the cabinet device;

wherein the support base has a non-hinged stabilizing portion that extends out a distance from the frame in a direction corresponding to a direction of movement of the first support structure from the closed position to the open position and is adapted to rest on and be supported by the support surface and thereby reduces a likelihood of tipping of the cabinet device when the first support structure is in the open position.

10. The apparatus of claim 9 further comprising:

a drinkware rimming dish removably positioned and supported in the recessed wetting receptacle.

11. The apparatus of claim 9 further comprising:

first edible granular drinkware rimming material supported by and in the first support structure and accessible when the first support structure is in the open position;

second edible granular drinkware rimming material supported by and in the second support structure and accessible when the second support structure is in the open position; and the second edible granular drinkware rimming material being a different granular material than the first edible granular drinkware rimming material.

12. The apparatus of claim 9 wherein:

the first support structure has a convex floor portion and an adjacent substantially flat, recessed floor portion; and the second support structure has a convex floor portion and an adjacent substantially flat, recessed floor portion.

13. The apparatus of claim 12 wherein:

the convex floor portion of the first support structure is continuous and circular; and the convex floor portion of the second support structure is continuous and circular.

14. The apparatus of claim 12 further comprising:

first edible granular drinkware rimming material supported in the substantially flat, recessed floor portion of the first support structure; and second edible granular drinkware rimming material supported in the substantially flat, recessed floor portion of the second support structure.

15. The apparatus of claim 9 wherein:

the first support structure is hollow; and the cabinet device includes a liner in the first support structure and configured to retain edible granular drinkware rimming material in and supported by the hollow first support structure.

16. The apparatus of claim 15 wherein:

the liner defines a first liner;

the edible granular drinkware rimming material defines first edible granular drinkware rimming material;

the second support structure is hollow; and the cabinet device includes a second liner in the second support structure and configured to retain second edible granular drinkware rimming material in and supported by the hollow second support structure.

17. The apparatus of claim 9 wherein the first and second support structures when in the closed positions are vertically aligned with respect to the support base.

18. The apparatus of claim 9 wherein the stabilizing portion of the support base is fixed relative to the frame.

19. The apparatus of claim 9 wherein the recessed wetting receptacle is positioned at a vertical position different than the vertical positions of the first and second support structures.

20. The apparatus of claim 9 wherein the cabinet device includes a third support structure connected to the frame and movable between an open position and a closed position, and the first, second and third support structures when in the closed positions are vertically aligned with respect to the support base.

21. The apparatus of claim 9 wherein the base has a non-skid bottom surface.

22. The apparatus of claim 9 wherein the cabinet device includes a separator that separates and divides the first and second support structures from one another and is configured to isolate any edible granular substances in the first and second support structures from one another.

23. An apparatus for use in applying an edible granular substance to a rim of drinkware, comprising:

a cabinet device including:

a support base adapted to rest on and be supported on a support surface;

a housing connected to the support base;

a first drawer connected to the housing and movable between an open position and a closed position; and a second drawer connected to the housing and movable between an open position and a closed position; and a recessed wetting receptacle supported by the cabinet device;

wherein the support base has a stabilizing portion that extends out a distance from the housing in a direction corresponding to a direction of movement of the first drawer from the closed position to the open position and is adapted to rest on and be supported by the support surface and thereby reduces a likelihood of tipping of the cabinet device when the first drawer is in the open position; and wherein the stabilizing portion is continuous with the rest of the support base.

24. The apparatus of claim 23 further comprising a drinkware rimming dish removably positioned and supported in the recessed wetting receptacle.

25. The apparatus of claim 23 further comprising:

first edible granular drinkware rimming material supported by and in the first drawer and accessible when the first drawer is in the open position;

second edible granular drinkware rimming material supported by and in the second drawer and accessible when the second drawer is in the open position; and the second edible granular drinkware rimming material being a different granular material than the first edible granular drinkware rimming material.

26. The apparatus of claim 23 wherein:

the first drawer has a convex floor portion and an adjacent substantially flat, recessed floor portion; and the second drawer has a convex floor portion and an adjacent substantially flat, recessed floor portion.

27. The apparatus of claim 26 further comprising:

first edible granular drinkware rimming material supported in the substantially flat, recessed floor portion of the first drawer; and second edible granular drinkware rimming material supported in the substantially flat, recessed floor portion of the second drawer.

28. The apparatus of claim 23 wherein:

the first drawer is hollow; and the cabinet device includes a liner in the first drawer and configured to retain edible granular drinkware rimming material in and supported by the hollow first drawer.

29. The apparatus of claim 23 wherein the first and second drawers when in the closed positions are vertically aligned with respect to the support base.

30. The apparatus of claim 23 wherein the stabilizing portion of the support base is fixed relative to the housing.

31. The apparatus of claim 23 wherein the recessed wetting receptacle is positioned at a vertical position different than the vertical positions of the first and second drawers.

32. The apparatus of claim 23 wherein the base has a non-skid bottom surface.

33. The apparatus of claim 23 wherein the cabinet device includes a separator that separates and divides the first and second drawers from one another and is configured to isolate any edible granular substances in the first and second drawers from one another.

34. An apparatus for use in applying an edible granular substance to a rim of drinkware, comprising:

a cabinet device including:

a support base;

a frame connected to the support base;

a first support structure connected to the frame and movable between an open position and a closed position; and a second support structure connected to the frame and movable between an open position and a closed position;

a recessed wetting area supported by the cabinet device; and a drinkware rimming dish removably positioned and supported in the recessed wetting area.

35. The apparatus of claim 34 further comprising:

first edible granular drinkware rimming material supported by and in the first support structure and accessible when the first support structure is in the open position;

second edible granular drinkware rimming material supported by and in the second support structure and accessible when the second support structure is in the open position; and the second edible granular drinkware rimming material being a different granular material than the first edible granular drinkware rimming material.

36. The apparatus of claim 34 wherein:

the first support structure has a convex floor portion and an adjacent substantially flat, recessed floor portion; and the second support structure has a convex floor portion and an adjacent substantially flat, recessed floor portion.

37. The apparatus of claim 36 further comprising:

first edible granular drinkware rimming material supported in the substantially flat, recessed floor portion of the first support structure; and second edible granular drinkware rimming material supported in the substantially flat, recessed floor portion of the second support structure.

38. The apparatus of claim 34 wherein:

the first support structure is hollow; and the cabinet device includes a liner in the first support structure and configured to retain edible granular drinkware rimming material in and supported by the hollow first support structure.

39. The apparatus of claim 34 wherein the first and second support structures when in the closed positions are vertically aligned with respect to the support base.

40. The apparatus of claim 34 wherein the stabilizing portion of the support base is fixed relative to the frame.

41. The apparatus of claim 34 wherein the recessed wetting receptacle is positioned at a vertical position different than the vertical positions of the first and second support structures.

42. An apparatus for use in applying an edible granular substance to a rim of drinkware, comprising:

a cabinet device including:

a support base;

a frame connected to the support base;

a first support structure connected to the frame and movable between an open position and a closed position; and a second support structure connected to the frame and movable between an open position and a closed position; and a recessed wetting receptacle supported by the cabinet device;

wherein the first support structure is hollow; and wherein the cabinet device includes a liner in the first support structure and configured to retain edible granular drinkware rimming material in and supported by the hollow first support structure.

* * * * *